US006309128B1

(12) United States Patent
Griebel et al.

(10) Patent No.: US 6,309,128 B1
(45) Date of Patent: Oct. 30, 2001

(54) APPLICATOR DEVICE

(75) Inventors: Ulrich Griebel, Altdorf; Willy Weiss; Georg Roeder, both of Schwabach, all of (DE)

(73) Assignee: Schwan-STABILO Cosmetics GmbH & Co., Heroldsberg (DE)

( * ) Notice: Subject to any disclaimer, the term of this patent is extended or adjusted under 35 U.S.C. 154(b) by 0 days.

(21) Appl. No.: 09/409,563

(22) Filed: Sep. 30, 1999

(30) Foreign Application Priority Data

Dec. 17, 1998 (DE) ..... 198 58 410

(51) Int. Cl.[7] ..... A47L 13/30
(52) U.S. Cl. ..... 401/264; 401/263; 401/266
(58) Field of Search ..... 401/264, 263, 401/265, 148, 205, 185, 171

(56) References Cited

U.S. PATENT DOCUMENTS

| | | | | |
|---|---|---|---|---|
| 2,442,503 | | 6/1948 | Melnikoff . | |
| 2,948,008 | * | 6/1960 | Leeds et al. | 401/263 |
| 3,256,551 | * | 6/1966 | Schwartzman | 401/264 |
| 4,201,491 | * | 5/1980 | Kohler | 401/264 |
| 4,772,148 | * | 9/1988 | Buschemeyer | 401/264 |
| 5,199,808 | * | 4/1993 | Gueret | 401/264 |

FOREIGN PATENT DOCUMENTS

| | | |
|---|---|---|
| 3430582 | 2/1986 | (DE) . |
| 19627606 | 1/1998 | (DE) . |
| 925899 | 9/1947 | (FR) . |
| 10192050 | 7/1998 | (JP) . |

* cited by examiner

*Primary Examiner*—David J. Walczak
(74) *Attorney, Agent, or Firm*—Bachman & LaPointe, P.C.

(57) ABSTRACT

A device for applying a liquid, paste or gel product to the skin, with a reservoir for the product, an abutment connected by at least one feed channel to the reservoir, and an applicator element that is provided with a plurality of passages for the product and whose outside surface forms an applicator surface.

The applicator element is held flexibly and/or movably with respect to the abutment so that it can assume at least one working position in which it, together with the abutment, borders a space to accommodate a predetermined quantity of the product, and where the space is reduced in size under deformation of the applicator element and/or movement of the applicator element with respect to the abutment.

13 Claims, 7 Drawing Sheets

APPLICATOR DEVICE

BACKGROUND OF THE INVENTION

This invention concerns a device for applying a liquid, paste or gel product to the skin, with a reservoir for the product, an abutment connected to the reservoir by at least one feed channel, and an applicator element that is provided with a plurality of passages for the product and has an outside surface which forms the applicator surface.

An applicator device of the type defined in the preamble is known, for example, from German Patent No. 3,430,582 A1. With the known applicator device, the surface of the abutment facing the applicator element is convex. Therefore, the applicator element, which is provided in the form of a cover, is adjacent to the abutment in such a way that product supplied to the abutment through the feed channel goes directly from the feed channel into the applicator element and from there to its outside surface.

Since the product goes directly from the feed channel into the applicator element, it preferably reaches the outside surface of the applicator element in the area of the mouth of the feed channel. However, areas of the applicator element that are not in the immediate proximity of the mouth of the feed channel are supplied with an inadequate amount of product or none at all. As an expedient, it is proposed that the product be applied to the applicator element over an area using a small spatula.

French Patent No. 925,899 A describes an applicator device with an applicator surface which may be formed by a fine-meshed element.

German Patent No. 19,627,606 A1 describes an applicator device for semisolid powdered materials. Here again, a surface-permeable cover which is in direct contact with the material serves as the applicator surface.

U.S. Pat. No. 2,442,503 A describes an applicator device for lipstick, where delivery channels open directly into an applicator surface. Here again, there is the problem of lipstick accumulating in the area of the mouth of the delivery channels.

The object of this invention is to improve upon an applicator device of the type defined in the preamble so that there will be a uniform distribution of the product without having to use a spatula or the like.

SUMMARY OF THE INVENTION

This object is achieved according to this invention with an applicator device of the type defined in the preamble due to the fact that the applicator element is held flexibly and/or movably with respect to the abutment so that it can assume at least one operating position in which it together with the abutment boarders a space to accommodate a predetermined amount of the product, and where the space is reduced in size with deformation of the applicator element and/or movement of the applicator element with respect to the abutment.

If, with the applicator device according to this invention, the product is conveyed through the feed channel, it will not go directly through the applicator element to the applicator surface, but instead it will first be distributed in the space bordered by the applicator element and the abutment. This space forms an intermediate storage where, in the extreme case, all the product added may accumulate. Due to the (uniform) distribution of product in the intermediate storage, the product will escape uniformly through the passages with further delivery, regardless of whether the passages are in the vicinity of a feed channel opening or not. It is not necessary to "boost" the application with a spatula to achieve a more uniform distribution.

Additional delivery may be accomplished in two ways. First, the additional delivery may result from additional supply of product through the feed channel. However, additional delivery can also be accomplished by simply using the applicator device. In other words, if the applicator device with the applicator element is placed on the skin and pressed (lightly), pressure increases in the space bordered by the applicator element and the abutment or in the entire product container due to deformation of the applicator element and/or due to movement of the applicator element in the direction of the abutment, so that product escapes through the passages on the applicator surface. Of course, this escape of product takes place in a uniform manner distributed over the applicator surface (in accordance with the distribution of the passages) Furthermore, only a maximum quantity of product corresponding to the intermediate storage escapes.

The applicator element may have any desired shape. For example, it may be flat. However, the applicator element is preferably dome-shaped in the resting position, with the inside of the dome forming the receptacle space for the product. This dome-shaped design has the particular advantage that the product can be applied especially precisely.

The applicator element preferably has a cover whose outside surface forms the applicator surface. One advantage of this embodiment is that the applicator element therefore has a certain mechanical stability and also shows hardly any wear in use.

The cover according to the present invention is preferably made of a plastic, metal and/or ceramic material. These materials have proven suitable in cosmetics, not least of all because of their smooth application surface, but also with regard to cleaning and hygiene.

The cover preferably has a metal screen.

According to this invention, the cover may have an eroded, grainy and/or wavy outside surface. Corresponding concave structures serve as additional intermediate storage.

The applicator element preferably overlaps with an outside edge of the abutment. This achieves the result that the application areas are free of interfering fastening elements such as a fastening frame. Therefore, it is smooth and free of edges.

According to this invention, is it preferable for the cover to be elastic. Therefore, it will always resume its resting position after use.

According to this invention, the cover may be held displaceably with respect to the abutment in the direction parallel to the feed channel. If pressure is exerted on the cover during use in this embodiment, it will move in the direction of the abutment, so that the pressure increases in the space accommodating the product.

It is also preferable according to this invention for the applicator element to have a foam element which is designed to absorb the product and it again. This achieves an even more uniform distribution of product. Furthermore, it is also preferable according to this invention for the foam element to fill out the receiving space for the product at least partially. Therefore, product entering the space is bound.

In addition to or as an alternative to the foam element, a fabric element may also be provided according to this invention, said fabric element being designed to absorb the product and dispense it again.

The fabric element may also fill up the receiving space for the product at least in part.

The foam element and/or the fabric element may have flocking. This improves the application properties.

To further improve the applicator properties, fibers projecting outward beyond the application surface may also be provided according to this invention.

These fibers may extend through the passages. This further improves the application properties.

It is especially preferable according to this invention for the passages to be closed in the resting state and to open when the product is applied to them under pressure.

In other words, the passages act like a "Bunsen valve." They open only when the product is conveyed from the space serving as the intermediate storage to the applicator surface, but otherwise they are closed so that then there is no danger of drying out when some of the product still remains in the receiving space which serves as interim storage for the product after use.

The surface of the abutment bordering the receiving space for the product may in principle be of any design. However, according to this invention it is preferably concave, which creates an especially large receiving space.

Finally, it is possible to provide according to this invention for the applicator surface of the applicator element to be arranged at an inclination to a main axis of the device. Such a design is advantageous with regard to handling.

BRIEF DESCRIPTION OF THE DRAWINGS

This invention is explained in greater detail below with reference to the accompanying figures with additional details. These figures show.

DETAILED DESCRIPTION

Figure 1:
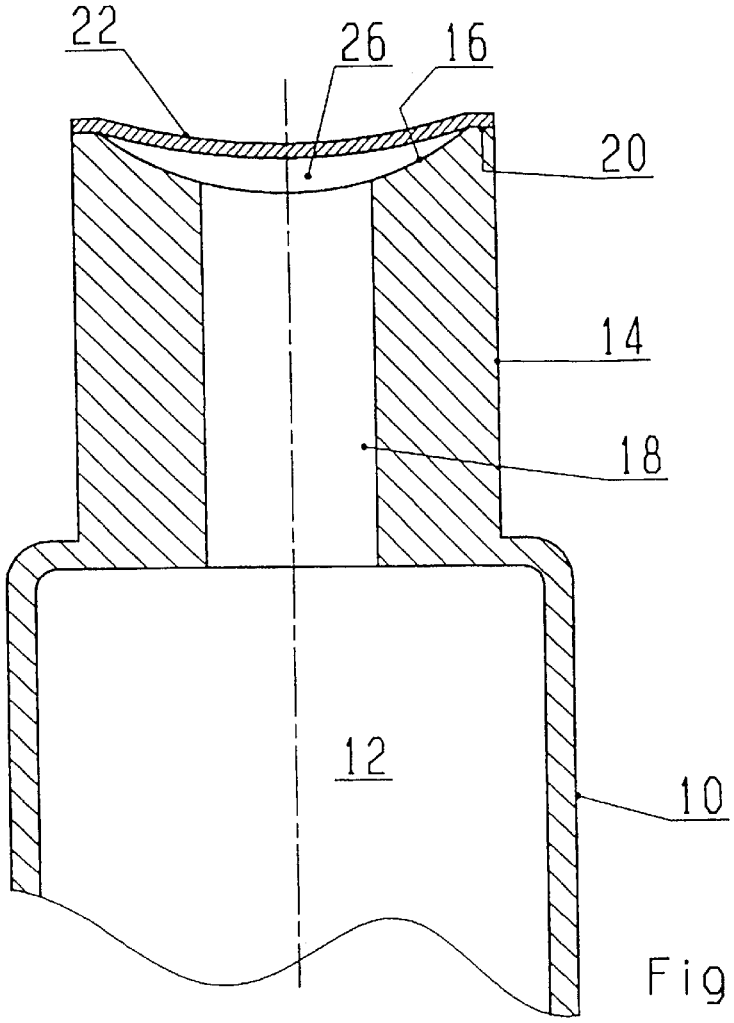
FIG. 1: an axial longitudinal sectional view through a first embodiment of the applicator device according to this invention.
Figure 2:
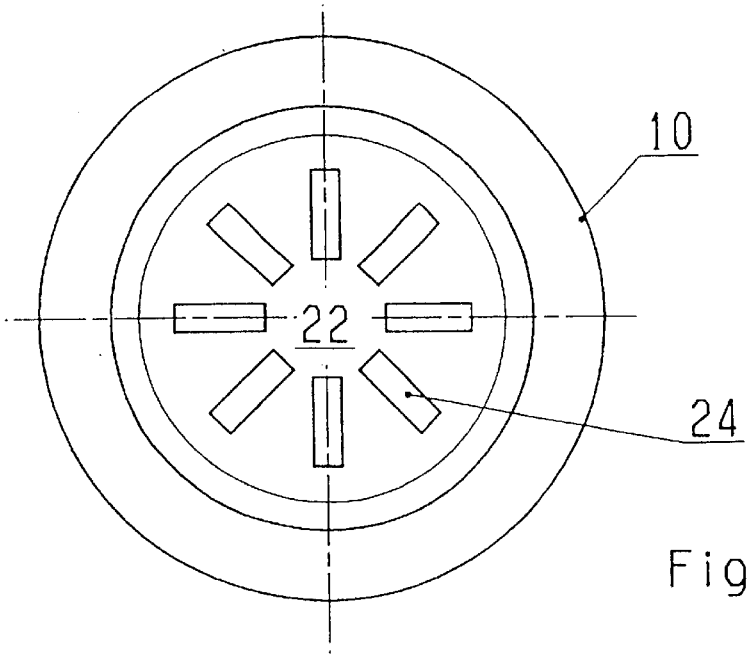
FIG. 2: a top view of the applicator device according to FIG. 1 showing the applicator element.

The applicator device shown in FIGS. 1 and 2 has a first reservoir 10 for a product 12. Reservoir 10 is shown only schematically. It may be a cylinder in which a piston is guided with a seal but displaceably. However, the reservoir may also be a tube which is operated by pressing it. Since such reservoirs are generally known (see, for example, U.S. Pat. No. 2,442,503 A), they need not be explained in greater detail here.

In addition to first reservoir 10, the applicator device according to FIGS. 1 and 2 also has an abutment 14. An end face 16 is designed as a concave surface on the free end of abutment 14. End face 16 is connected to reservoir 10 by a feed channel or passage 18. A cover 22 in the form of a moveable applicator element is attached, e.g., by gluing to one edge 20 of end face 16.

The cover may be, for example, a foam plastic with rubber elastic properties.

Slots are provided in cover 22, for example, by punching, cutting, beating or laser cutting; one of these slots is shown with reference number 24 in FIG. 2. It should be pointed out explicitly here that the slots are not drawn to scale. In reality, they are narrower in comparison with the other dimensions. Slots 24 are designed so that they are closed in the resting state, i.e., when no excess pressure is prevailing in a space 26 (second reservoir) bordered by cover 22 on the one hand and end face 16 of abutment 14 on the other hand, whereas they open as a result of an excess pressure in space 26 (which is variable in volume) to allow the product to pass through. Thus, slots 24 act as valved passages which are selectively opened.

Cover 22 may also be a fine mesh metal screen.

The embodiment illustrated in FIGS. 1 and 2 functions as follows:

First a pressure is produced in reservoir 10, e.g., by operating a piston or by pressing on a tube. This pressure causes the product 12 to be conveyed through feed channel 18 into space 26. Since cover 22 presents a certain flow resistance, space 26 will fill up before product 12 can pass through the passages or slots 24 if the delivery of product 12 continues through feed channel 18. Cover 22 begins to "swell up" in the process, i.e., it bulges outward. However, after space 26 has become filled with the product 12, the product 12 is pressed uniformly through all the passages or slots 24 as the pressure continues to act. Since the passages or slots are distributed uniformly over the cover 22 and thus over the end face 16 of abutment 14, the product 12 is automatically distributed uniformly on the outside of cover 22 merely by producing a pressure in reservoir 10 or in space 26. Therefore, there is no need for the additional use of a spatula or the like.

Figure 3A:
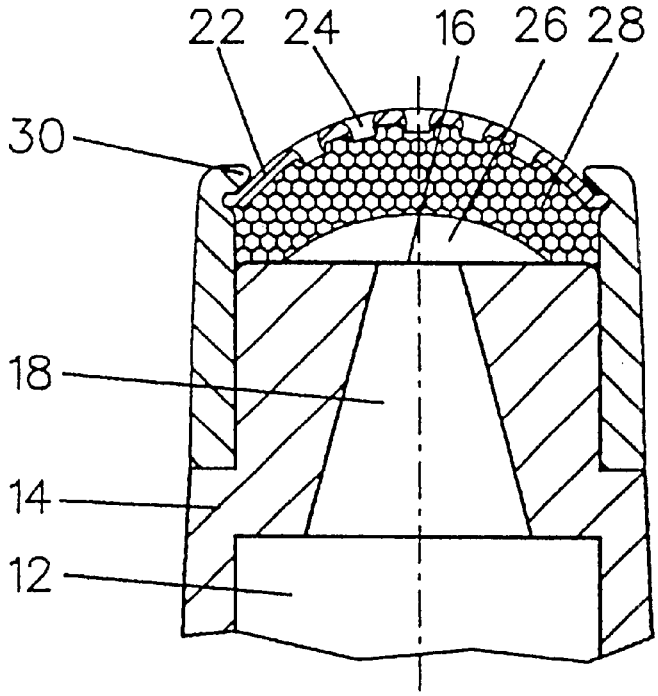
FIGS. 3*a* to 6: axial longitudinal sectional views of other embodiments of the applicator device according to this invention.
Figure 3B:
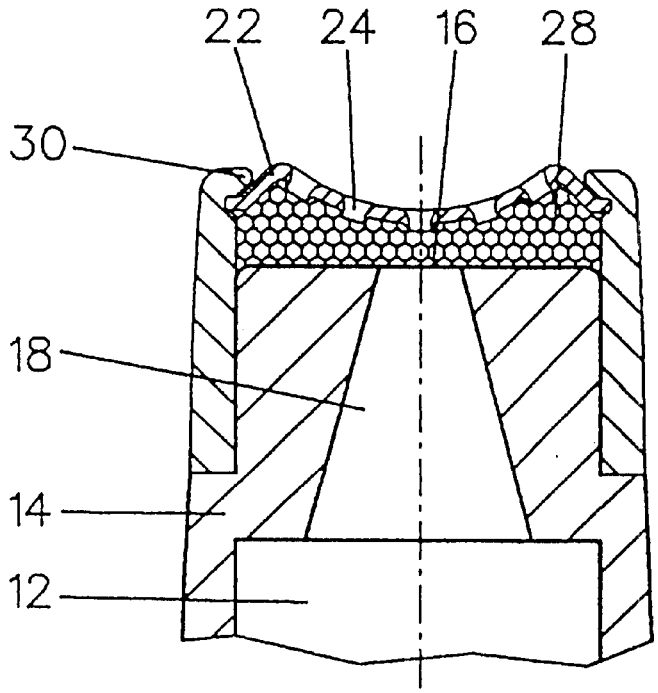

The embodiment according to FIGS. 3*a* and 3*b* corresponds essentially to that according to FIGS. 1 and 2, but end face 16 of abutment 14 is not concave but instead it is flat, whereas cover 22 is dome-shaped. According to FIG. 3*a,* a foam element 28 partially fills space 26. The foam used in this process is an open-poured foam. It may be flocked. Furthermore, fibers extend from foam element 28 through passages 24.

The cover is made of a flexible material such as plastic or metal. If pressure is applied to cover 22 during use, it deforms so that it assumes the shape shown in FIG. 3*b,* for example. Then foam element 28 completely fills up the (remaining) space 26. It may also be compressed. The resulting pressure in space 26 causes the product 12 to go through the passages 24 onto the outside of cover 22.

FIGS. 3*a* and 3*b* shows cover 22, which is held at its edges by means of a holding element 30.

Figure 4A:
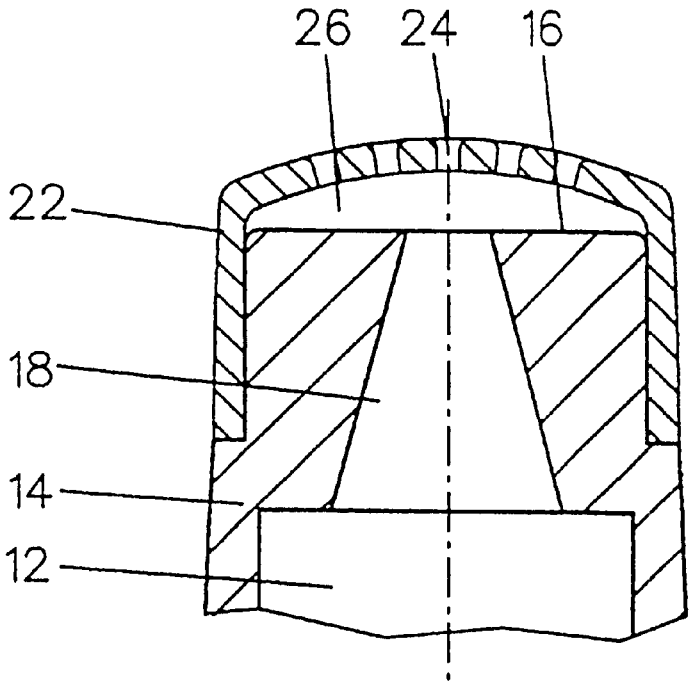
Figure 4B:
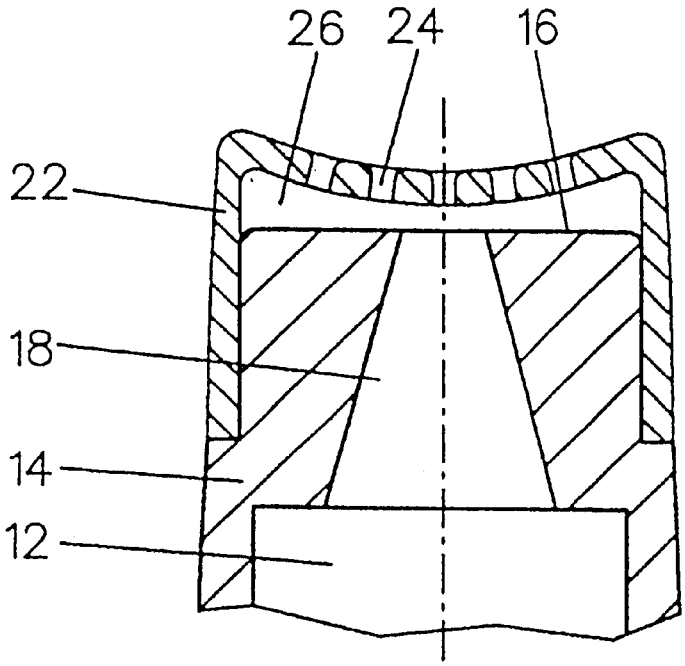

However, the embodiment illustrated in FIGS. 4*a* and 4*b* provides for cover 22 to be attached directly to abutment 14. As shown in FIG. 4*b*, the pressure in space 26 can be increased by the fact that cover 22 becomes indented in the axial direction. In addition, however, there is also the possibility of a pressure increase in space 26 in that cover 22 according to FIGS. 4*a* and 4*b* can be deflected radially, i.e., from the left to the right, for example.

In the embodiment according to FIGS. 4*a* and 4*b,* it is also possible to provide for the space 26 to be filled entirely or partially with a foam element 28. A fabric element may also be used instead of foam.

Figure 5A:
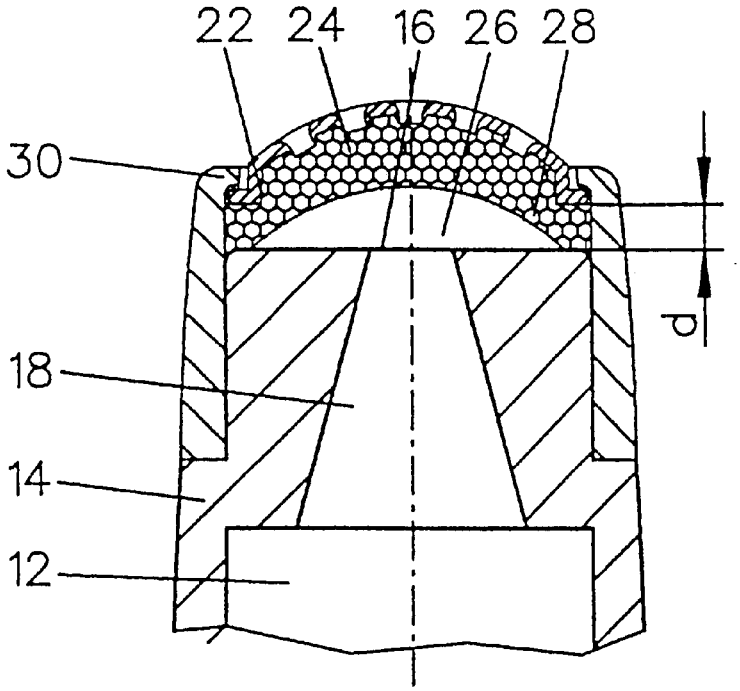
Figure 5B:
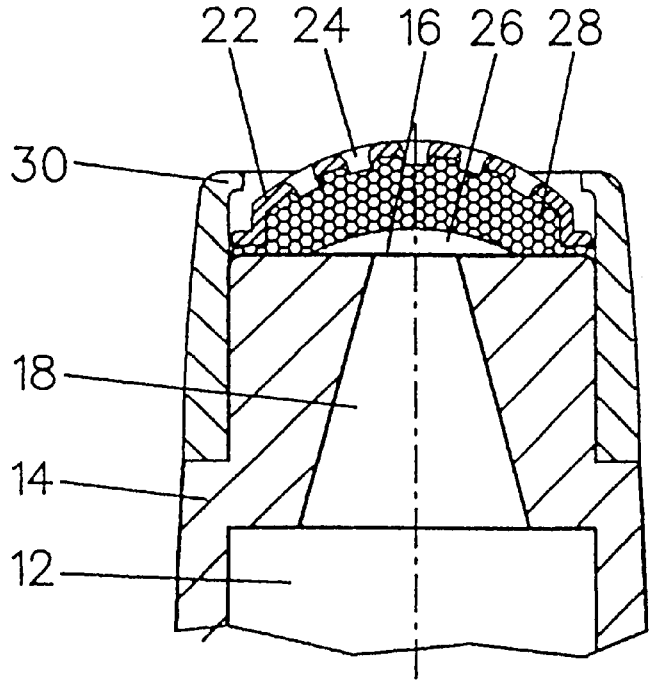

The embodiment according to FIGS. 5*a* and 5*b* differs from that according to FIGS. 3*a*–4*b* in that the cover 22 can be displaced downward in the drawing as a whole in order to increase the pressure in space 26. In view of this displaceability, the cover need not necessarily be made of a flexible material such as metal or plastic, although these possibilities are not ruled out. In addition, however, it may also be made of a nonflexible material such as a ceramic material.

As shown in FIG. 5*a*, cover 22 may be displaced by a distance d with respect to abutment 14.

Figure 6:
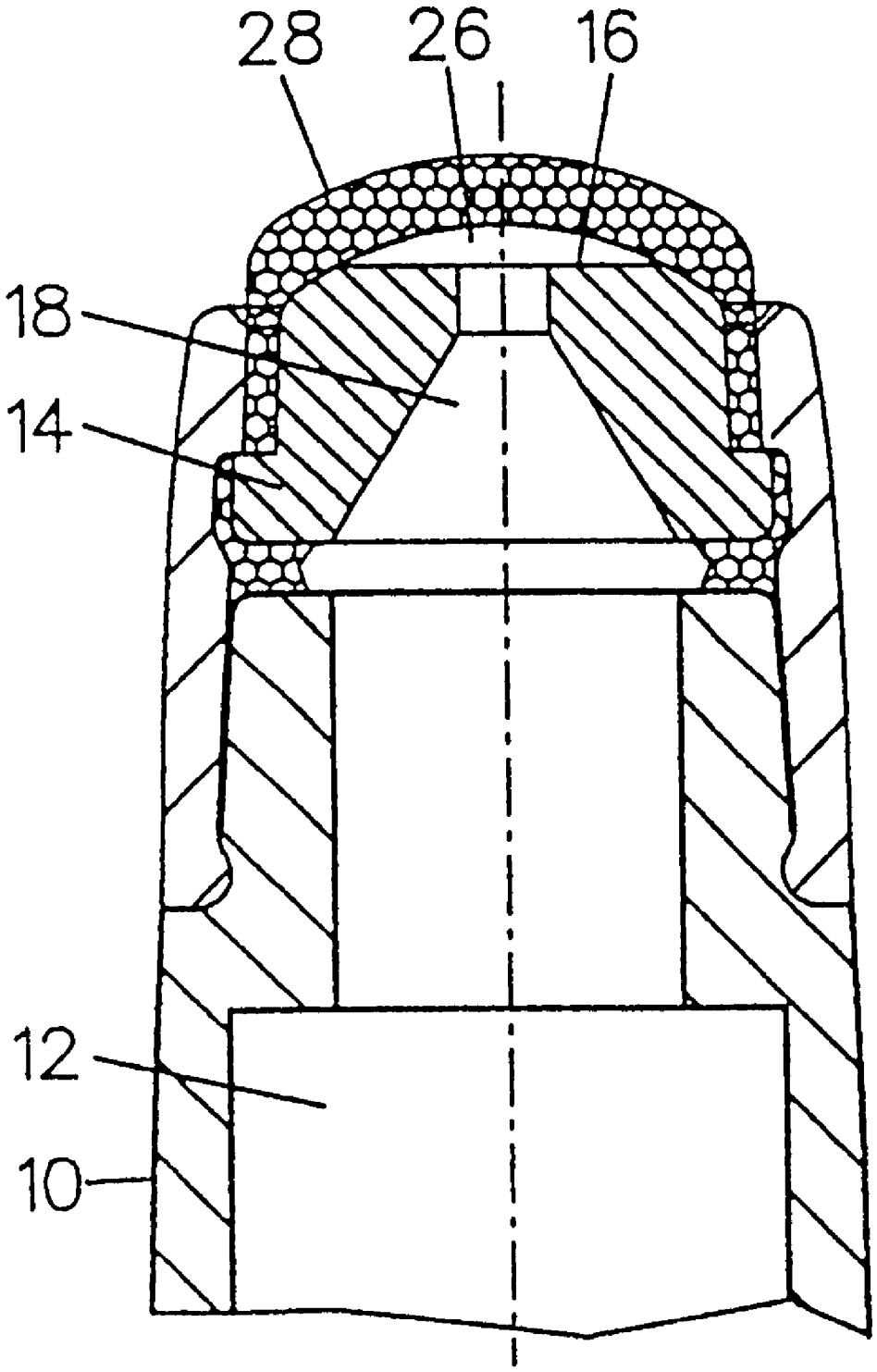

The design according to FIG. 6 corresponds largely to that according to FIGS. 3*a*–4*b*, but with the difference that abutment 14 is itself held displaceably (from top to bottom in the drawing). The actual applicator element in this embodiment is formed by the foam element 28 which also extends below the abutment 14, so that abutment 14 is prestressed in the direction of foam element 28.

Figure 9:
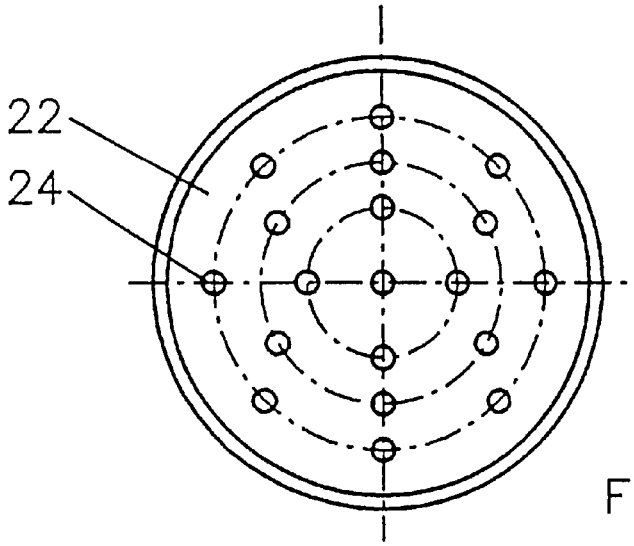
FIGS. 7 to 9: top views of additional embodiments of the applicator element.
Figure 8:
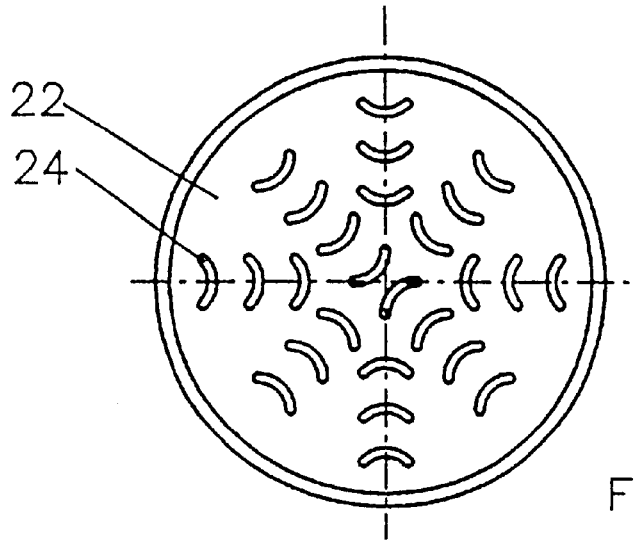
Figure 7:
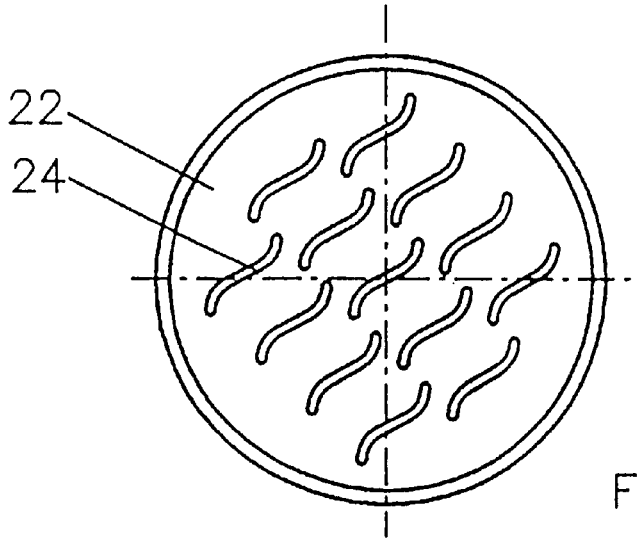

According to FIGS. 7 to 9, passages 24 may have a variety of shapes. It should be pointed out explicitly that passages 24 may also have shapes different from those illustrated in FIGS. 2 and 7 through 9.

According to FIGS. 7 through 9, the applicator surface is round. However, it may also have any other desired shape, such as an oval, rhomboid, triangular, square or rectangular shape, etc.

Figure 10:
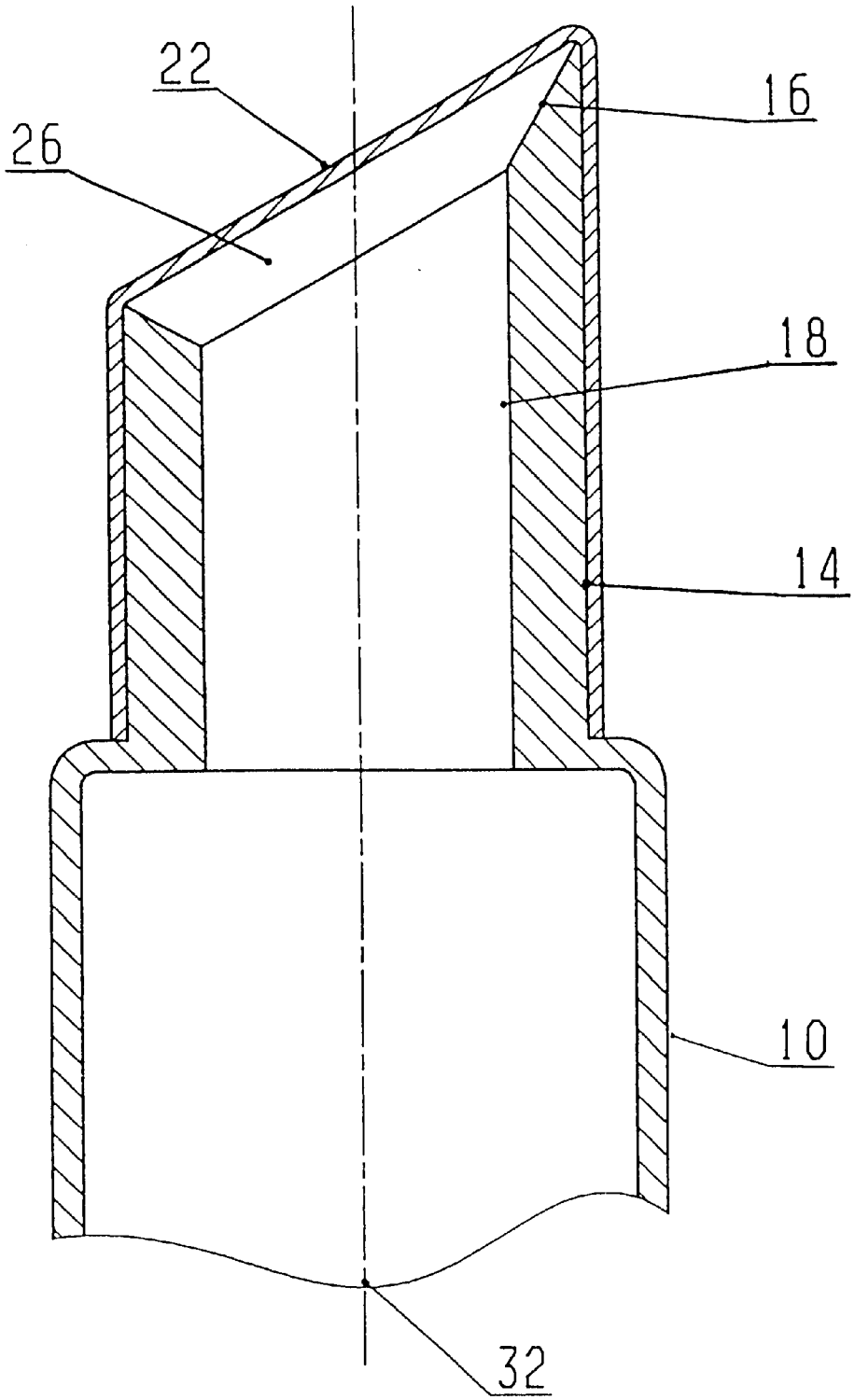
FIG. 10: a schematic diagram of another embodiment of the applicator device according to this invention, but in a side view.

FIG. 10 shows a schematic diagram of another possibility for orientation of the applicator element, which is formed in this case by cover 22. The particular aspect of this is that the applicator surface of the applicator element is inclined at an angle to a main axis 32 in this case.

In the embodiments according to FIGS. 4*a*, 4*b* and 10, the applicator element or the cover 22 overlaps with the outside edge of abutment 14. Therefore, the applicator surface is free of fastening elements for attaching the cover 22 to the abutment 14. Therefore, it is smooth and free of edges.

The features of this invention disclosed in the specification, the claims and the drawings may be essential for the implementation of this invention and its various embodiments either individually or in any desired combination.

What is claimed is:

1. A device for applying a product comprising:

a first reservoir containing the product;

an abutment having at least one feed passage having an inlet and an outlet for receiving product from the first reservoir through the inlet and delivering product to the outlet;

a second variable volume reservoir defined between the abutment and a moveable applicator element for receiving product from the outlet of the at least one feed passage of the abutment such that the product moves the applicator element and increases the volume of the second reservoir for receiving the product, the movable applicator having a plurality of selectively opened valved passages for transferring product from the second reservoir to an application surface of the movable applicator when opened wherein the valved passages are selectively opened in response to (1) delivering of excess product from the first reservoir through the at least one feed passage to the second reservoir and (2) pressure asserted on the application surface of the movable applicator element.

2. A device according to claim 1, wherein the movable applicator is dome-shaped in a resting position.

3. A device according to claim 1, wherein the movable applicator element has a cover having an outside surface forms the application surface.

4. A device according to claim 3, wherein the cover is elastic.

5. A device according to claim 3, wherein the cover is displaceable with respect to the abutment in a direction parallel to the at least one feed passage.

6. A device according to claim 3, wherein the cover is made of a material selected from the group consisting of plastic, metal and ceramic.

7. A device according to claim 3, wherein the cover is provided with a metal screen.

8. A device according to claim 1, wherein the movable applicator overlaps an outside edge of the abutment.

9. A device according to claim 1, wherein the movable applicator includes an element which absorbs the product and dispenses it.

10. A device according to claim 9, wherein the element at least partially fills up the second reservoir for the product.

11. A device according to claim 9, wherein the movable applicator has a foam element.

12. A device according to claim 1, wherein the abutment is provided with a concave surface defining the second reservoir for the product.

13. A device according to claim 1, wherein the application surface is inclined at an angle with respect to the longitudinal axis of the device.

* * * * *

UNITED STATES PATENT AND TRADEMARK OFFICE

CERTIFICATE OF CORRECTION

PATENT NO. : 6,309,128 B1
DATED : October 30, 2001
INVENTOR(S) : Ulrich Griegel et al.

It is certified that error appears in the above-identified patent and that said Letters Patent is hereby corrected as shown below:

Column 2,
Line 18, insert -- . -- after "passages)".

Column 6, claim 3,
Line 2, insert -- which -- after "surface".

Signed and Sealed this

Nineteenth Day of March, 2002

*Attest:*

*Attesting Officer*

JAMES E. ROGAN
*Director of the United States Patent and Trademark Office*